United States Patent [19]

Anders

[11] 3,998,629

[45] Dec. 21, 1976

[54] METHOD FOR RECOVERING SMALL PARTICLES OF HEAVY PRECIOUS METALS BY AMALGAMATION

[76] Inventor: Edward O. Anders, 1502 Tallulah Court, Houston, Tex. 77077

[22] Filed: Dec. 22, 1975

[21] Appl. No.: 643,528

[52] U.S. Cl. ..... 75/109; 75/121; 266/169

[51] Int. Cl.[2] ..... C22B 11/10; C22B 11/12

[58] Field of Search ..... 75/109, 121; 266/169

[56] References Cited

UNITED STATES PATENTS

| | | | |
|---|---|---|---|
| 2,223,832 | 12/1940 | Rulison | 75/109 |
| 3,729,182 | 4/1973 | Schafer et al. | 266/9 |

FOREIGN PATENTS OR APPLICATIONS

| | | | |
|---|---|---|---|
| 1,001,238 | 8/1965 | United Kingdom | 75/109 |

*Primary Examiner*—G. Ozaki
*Attorney, Agent, or Firm*—W. F. Hyer; Marvin B. Eickenroht

[57] ABSTRACT

There is disclosed a method and apparatus for recovering small particles of gold or platinum from a slurry by feeding the slurry onto a layer of mercury which is flowing downwardly along a generally conical, downwardly converging inner wall of a housing. The housing is rotated about the vertical axis of the conical wall at a speed which induces particles to settle out or amalgamate with the layer of mercury and causes the remainder of the slurry to move upwardly over the mercury layer and out of the housing. Upon collection and separation of the particles therefrom, the mercury is returned to the housing for resupply to the inner wall thereof so as to maintain a continuous layer of mercury.

4 Claims, 2 Drawing Figures

METHOD FOR RECOVERING SMALL PARTICLES OF HEAVY PRECIOUS METALS BY AMALGAMATION

Figure 1:
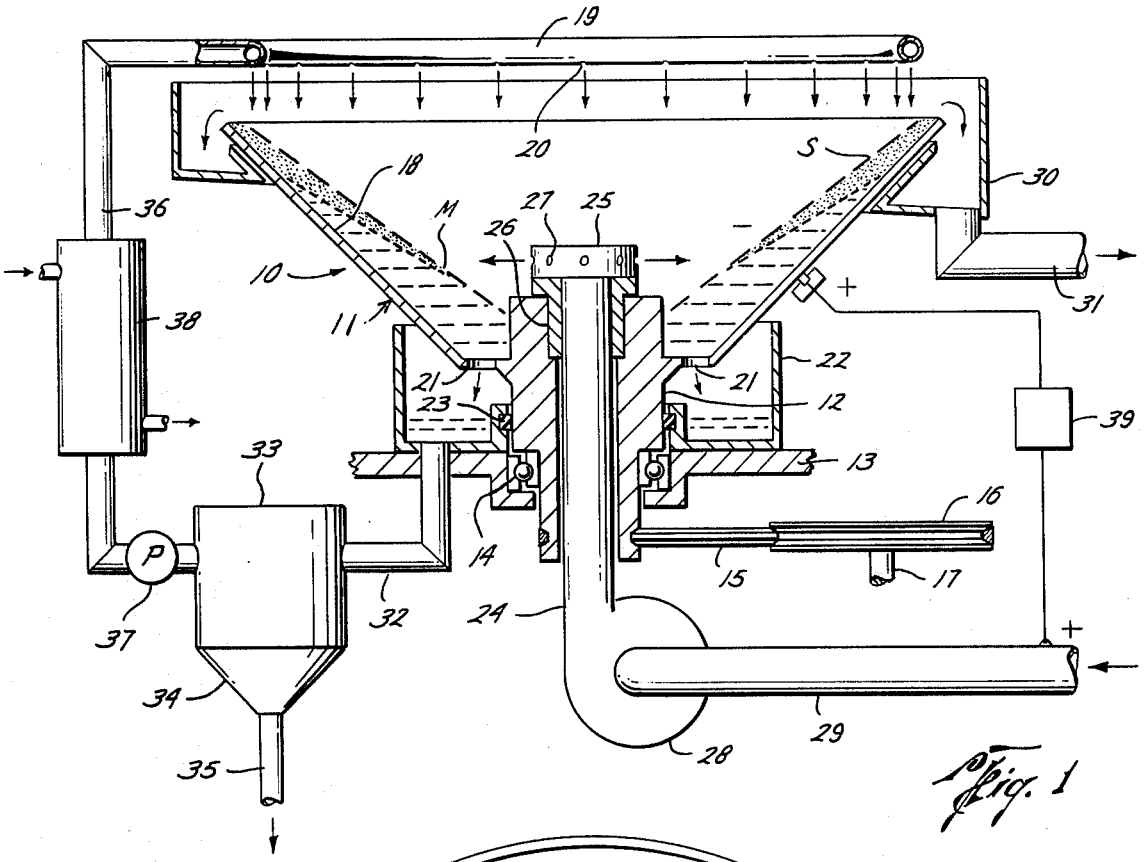

This invention relates to an improved method and apparatus for recovering small particles of heavy precious metals such as gold or platinum from the extraneous material with which they are mined.

Large deposits of small, often microscopic particles of gold are known to exist in the mud and silt along and off the shoreline of Alaska. These particles, which are known as placers, have broken off from the veins of lode formations in the mountainous areas adjacent the shoreline, and, over the ages, have been washed down to the shoreline by the mountain streams. However, these gold particles are present in the mud and silt in very small concentrations, such as 0.005 ounces per ton of mud and silt. Hence, known chemical processes for removing large volumes of gold particles or similar small particles of platinum from the extraneous material with which they are mined are not economical or otherwise practical.

It has long been the practice to recover gold particles from stream beds causing a slurry of the stream bed materials to flow through a sluice having mercury traps along its length. The gold particles would separate out from the lighter elements of the extraneous material, and, being heavier than the mercury, would either settle into or amalgamate with the mercury. Periodically, the mercury with the gold particles therein would be heated to its evaporation temperature, which is below that of the gold particles, to permit the latter to be separated out. However, this process, which relies solely upon the force of gravity to cause the gold particles to enter the mercury, is obviously not practical on the mass production basis which would be required to economically recover gold particles in the small concentrations above noted.

It is therefore an object of this invention to provide an economical and otherwise practical method and apparatus for removing small particles of gold or platinum from the formation materials with which they are mined.

This and other objects are accomplished, in accordance with the illustrated embodiment of the invention, by a method and apparatus in which mercury is supplied to a generally conical, downwardly converging inner wall of the housing to cause a layer of the mercury to flow downwardly therealong, and a slurry containing the small particles and other extraneous material is fed onto the layer of mercury. The housing is rotated about the vertical axis of the generally conical wall at a speed which induces the particles to settle in or amalgamate with the layer of mercury and causes the remainder of the slurry to move upwardly over the mercury layer and out of the housing, while permitting the mercury layer to flow downwardly along the housing wall at a relatively slow rate.

The mercury layer and the particles which flow downwardly therewith over the conical wall of the housing are collected, and the particles are then separated from the mercury. More particularly, the mercury from which the particles have been separated is returned for resupply to the inner wall of the housing so as to maintain a continuous layer of mercury thereover. In this way, the recovery process may be on a continuous basis, thus providing a practical way to recover the particles despite their small concentration in the extraneous material of the slurry.

Figure 2:
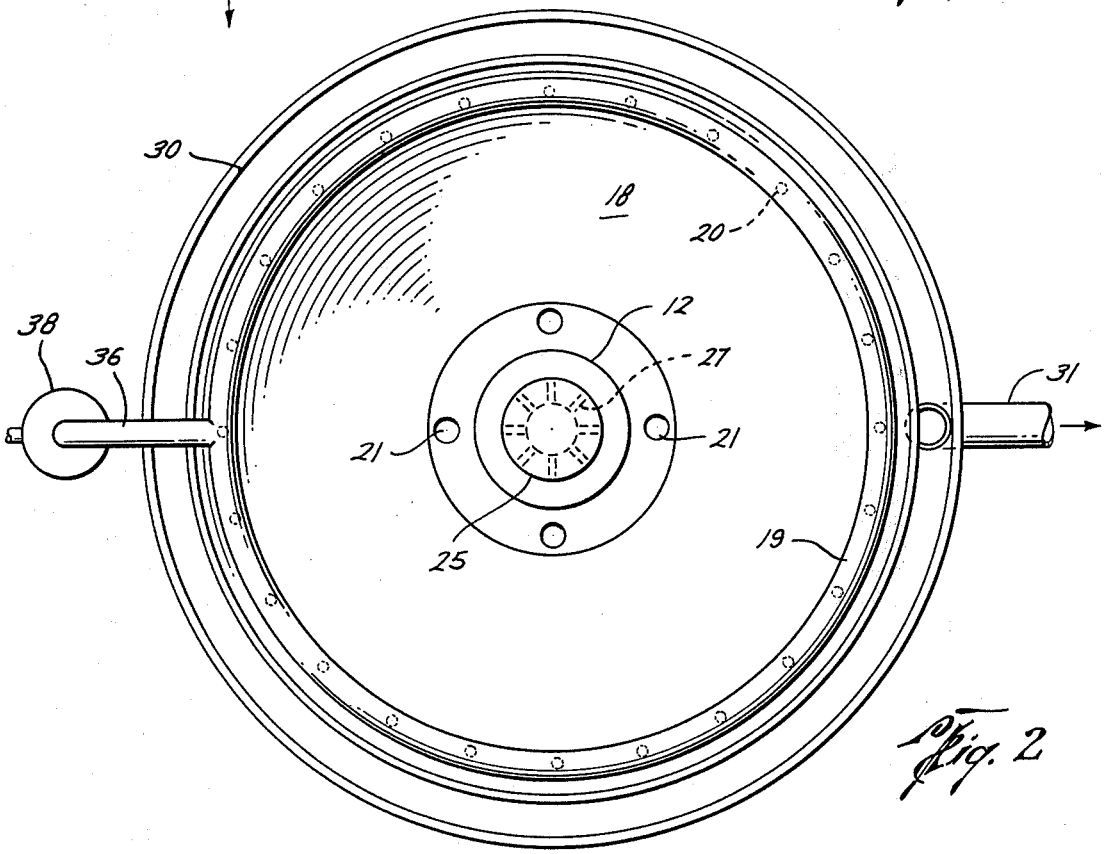

In the drawings, wherein like reference characters are used throughout to designate like parts:

FIG. 1 is a diagrammatic view, partly in cross-section and partly in elevation, of apparatus constructed in accordance with the present invention; and FIG. 2 is a plan view of the apparatus of FIG. 1.

With reference to the details of the drawings, the illustrated apparatus includes a housing, indicated in its entirety by reference character 10 and comprising a hollow body 11 mounted on a vertically disposed shaft 12. The shaft is in turn mounted on a fixed horizontal support 13 by means of bearings 14 so as to permit it, and thus hollow body 11, to be rotated about its vertical axis. The shaft is rotated by means of a belt 15 disposed about the lower end of the shaft beneath the support 13, and a sheave 16 mounted on a vertical shaft 17. A motor (not shown) is connected to shaft 17 in order to rotate it, and thus shaft 12, at a desired speed.

As previously described, the body 11 of the housing has a generally conical, downwardly converging, inner wall 18, and mercury is supplied to this wall to cause a layer thereof to flow downwardly therealong. More particularly, mercury is supplied thereto from a header 19 comprising a tubular ring mounted above the upper end of wall 18 and having outlet ports 20 spaced circumferentially thereabout. Thus, as indicated by the arrow in FIG. 1, the mercury is supplied in substantially equally spaced apart streams so as to form a layer M which quickly spreads about the entire circumference of the wall.

Although centrifugal force due to rotation of the housing will force the mercury layer against the wall 18, the angle of wall 18 with respect to the vertical and the speed of rotation of the housing are such that the layer nevertheless is free to flow downwardly therealong, although at a relatively slow rate. As it flows downwardly along wall 18, it passes through orifices 21 in the lower end of body 11 and thus into an annular collection container 22 mounted on support 13 and disposed about shaft 12. These orifices are preferably variable in size so that they may be adjusted depending on the flow rate of the mercury layer. More particularly, the container is fixed to the stationary support 13 and carries a seal ring 23 to form a sliding seal about the shaft 12.

A slurry containing gold particles, as well as water and the mud and silt in which the gold particles are contained, is fed to the mercury layer M through a conduit 24 which passes upwardly and axially through shaft 12. Alternatively, of course, the particles may be platinum which, similarly to gold, will amalgamate with the mercury. More particularly, the slurry is fed to the mercury layer by means of a head 25 on the upper end of conduit 24 which is supported on the upper end of shaft 12 by means of a bearing 26. The head 25 has ports 27 spaced circumferentially thereabout so as to feed the slurry radially outwardly against the mercury layer, as indicated by the arrows in FIG. 1. The slurry is pumped upwardly through conduit 24 and out of the head 25 by means of a pump 28, and slurry is supplied to the pump through another conduit 29 extending from the source of the slurry (not shown).

As illustrated, conduit 24 as well as head 25 are not rotatable with the body, but instead, and as illustrated in the preferred embodiment of the invention, are stationary. This relative rotation between the mercury layer and slurry as the latter is fed outwardly onto the mercury layer, causes agitation at the inner face of the mercury layer which is believed to promote settling and amalgamation of the gold particles in the slurry. In fact, the means for feeding the slurry may be rotated in a direction opposite to that of the rotation of the housing in order to promote even additional agitation.

In any event, as the slurry is fed to the mercury layer, it is caused to settle therein or amalgamate therewith not only by virtue of the gravity of the gold particles, but also by virtue of the centrifugal force on the slurry and the mercury layer, which of course, induces movement of the particles into the mercury. Furthermore, the angle of the wall 18 with respect to the vertical and speed of rotation of the housing are such that a layer S of the slurry is caused to move upwardly along the layer of mercury M and over the upper edge of wall 18 for removal from the housing. This is made possible, of course, by virtue of the fact that the water and the extraneous solid particles in the slurry are sufficiently lighter than the mercury that the centrifugal force overcomes the effect of gravity thereon to cause them to move upwardly despite downward movement of the mercury layer.

As shown in the drawings, an annular trough 30 is mounted about the upper edge of the wall 18 so as to receive the upwardly moving layer of slurry S as it spills over the edge. A conduit 31 connects with the lower end of the trough for conducting the slurry either to a suitable place of disposal or return to the supply conduit 29 in the event a sufficient quantity of small particles have not settled out or amalgamated with the mercury to make it economically feasible to recirculate the slurry through the housing.

A conduit 32 connects the lower end of container 22 so as to conduct the mercury and gold particles collected therein to a boiler 33. In the boiler, which may be of conventional construction, the mercury and gold particles therein are heated to the vaporation temperature of the mercury, which is below that of the gold so as to vaporize the mercury and thus permit the gold to settle out therefrom. As the mercury vaporizes, the gold particles thus fall by gravity into a hopper 34 beneath the boiler from which they may be removed through a conduit 35 connected with the lower end of the hopper.

A conduit 36 connects the boiler with the header 19 through which mercury is supplied, and a pump 37 is disposed in conduit 36 for returning the mercury from which the gold particles have been separated back to the header, whereby it may again be supplied to the inner wall 18 of the housing. The mercury vapor from boiler 33 is condensed within a condenser 38 disposed in line 36 downstream of pump 37 so that it is in liquid form as it reaches the header 19.

As shown in FIG. 1, a suitable means 39 is provided for applying a positive charge to each of slurry supply conduit 29 and hollow body 11. In this manner, each of the slurry, including the gold particles therein, and the layer of mercury flowing downwardly over the inner wall 18 of the hollow body are also positively charged. Since the mercury layer M is a conductor, its inner face which the slurry is fed is negatively charged. As will be understood, this negative charge attracts the positive charge applied to the gold particles in the slurry, and thus promotes movement of such particles into the mercury layer.

From the foregoing it will be seen that this invention is one well adapted to attain all of the ends and objects hereinabove set forth, together with other advantages which are inherent to the method and apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A method for recovering small particles of heavy precious metals such as gold or platinum from a slurry, comprising the steps of supplying mercury to a generally conical, downwardly converging, inner wall of a housing to cause a layer of the mercury to flow downwardly therealong, feeding the slurry onto the layer of mercury, rotating the housing about the vertical axis of the generally conical wall at a speed which induces the particles to settle in or amalgamate with the layer of mercury and causes the remainder of the slurry to move upwardly over the mercury layer and out of the housing, collecting the mercury and particles which flow downwardly therewith over the wall of the housing, separating the particles from the collected mercury, and returning the mercury from which the particles have been separated back to the inner wall of said housing for maintaining a continuous layer of mercury.

2. A method of the character defined in claim 1, including the additional steps of heating the collected mercury to a temperature which causes it to vaporize without vaporizing the particles, whereby such particles may be separated therefrom, and causing the mercury to condense prior to its return to the inner wall of the housing.

3. A method of the character defined in claim 1, including the additional step of applying a positive charge to each of the outer face of the mercury layer adjacent the housing wall and the slurry prior to feeding of the slurry to the layer, whereby the inner face of said layer is negatively charged to attract the positive charge applied to the particles in the slurry.

4. A method of the character defined in claim 1, including the steps of supplying the mercury to the housing wall in a generally circular pattern concentric with the vertical axis of the wall, and feeding the slurry radially outwardly against the housing wall from a location generally centrally thereof.

* * * * *